US010386049B2

(12) United States Patent
Yu et al.

(10) Patent No.: US 10,386,049 B2
(45) Date of Patent: Aug. 20, 2019

(54) CONFIGURABLE MULTIMOUNT TASK LIGHTING SYSTEM

(71) Applicants: Scott S Yu, Tiburon, CA (US); Rick Wong, Sonoma, CA (US)

(72) Inventors: Scott S Yu, Tiburon, CA (US); Rick Wong, Sonoma, CA (US)

(73) Assignee: Vode Lighting, LLC, Sonoma, CA (US)

( * ) Notice: Subject to any disclaimer, the term of this patent is extended or adjusted under 35 U.S.C. 154(b) by 63 days.

(21) Appl. No.: 15/589,967

(22) Filed: May 8, 2017

(65) Prior Publication Data

US 2018/0320869 A1 Nov. 8, 2018

(51) Int. Cl.

| | |
|---|---|
| ***F21V 21/00*** | (2006.01) |
| ***F21V 21/096*** | (2006.01) |
| ***F21L 14/02*** | (2006.01) |
| ***F21V 21/30*** | (2006.01) |
| *F21V 21/088* | (2006.01) |

(52) U.S. Cl.

CPC ..... *F21V 21/096* (2013.01); *F21L 14/02* (2013.01); *F21V 21/30* (2013.01); *F21V 21/088* (2013.01)

(58) Field of Classification Search

CPC ..... F21V 21/096; F21V 21/14; F21V 21/26; F21V 21/34; F21V 21/35; F21V 21/005; F21V 21/08; F21V 21/02; F21V 21/045

USPC ..... 362/398

See application file for complete search history.

(56) References Cited

U.S. PATENT DOCUMENTS

| | | | | | |
|---|---|---|---|---|---|
| 3,917,940 | A * | 11/1975 | Duddy | F21S 6/003 | 362/398 |
| 5,333,103 | A * | 7/1994 | Cvek | F16M 11/105 | 362/402 |
| 5,422,802 | A * | 6/1995 | Lin | F16M 11/10 | 362/269 |
| 2005/0185398 | A1 * | 8/2005 | Scannell, Jr. | A01G 9/02 | 362/227 |
| 2014/0334166 | A1 * | 11/2014 | Yang | F21V 21/096 | 362/398 |

* cited by examiner

*Primary Examiner* — Matthew J. Peerce

(74) *Attorney, Agent, or Firm* — Peter Tormey; Michael Petrin

(57) ABSTRACT

The present invention relates generally to lighting systems, and more particularly to a freely adjustable, exchangeable and configurable lighting system that can be reconfigured, mounted and positioned in multiple independent configurations to provide task lighting to illuminate a specific area. The present invention relates more specifically to a reconfigurable lighting system employing surface connection means, support means and adjustment means to enable a task lighting element to be mounted to any desired vertical or horizontal surface, fixture or edge thereof. The present invention also relates more specifically to a magnetically enabled coupling and adjustment means that enables a task lighting element to be positioned at a selected rotational or angular orientation by hand, yet maintain its position against the force of gravity. The present invention also relates more specifically to a magnetically enabled parallelogram positioning system that enables a task lighting element to be positioned at a selected distance, height or angular orientation by hand, yet maintain its position against the force of gravity.

1 Claim, 11 Drawing Sheets

CONFIGURABLE MULTIMOUNT TASK LIGHTING SYSTEM

BACKGROUND

The present invention relates generally to lighting systems, and more particularly to a freely adjustable, exchangeable and configurable lighting system that can be reconfigured, mounted and positioned in multiple independent configurations to provide task lighting to a specific illuminated area. Lighting and electrical fixture system designs are driven by new technologies and by demands for more efficiency from the market. To meet these demands fixture designers attempt to control costs by creating reusable components that provide for multiple uses of a same or similar component. Reusability often depends on the ability to mount or reposition a lighting system when rearranging an office or workspace setting in response to changes in the needs of the organization. Lighting fixture designers strive to meet changing demands by incorporating new technologies and modern aesthetics into fixture designs. As such, what is needed is a cost effective modular lighting fixture that enables a user multiple mounting configurations and the ability to change mounting and positions easily without the need for tools, altering the office or workspace or rewiring, thus providing for ease of installation and reconfiguration whenever needed.

SUMMARY

Disclosed herein are embodiments of an inventive modular lighting system comprising a mounting element; wherein said mounting element is configured to be removably attachable to a surface; wherein said mounting element has a first proximate side configured to attach to a receptive surface and a second distal side configured with a means to removable attach to a coupling element; wherein said mounting element is selected from a mounting means capable of attaching to a flat horizontal surface, flat vertical surface, an edge or surface of an object selected from a cubicle wall, table, chair, computer monitor, display screen, keyboard, desk, pole and office equipment; a coupling element, removably attachable to said mounting element; wherein said coupling element has a first proximate side configured to removably attach to said mounting element and a second distal side configured to removably attach to a light engine; a light engine, removably attachable to said coupling element; wherein said light engine has a first proximate side configured to removably attach to said coupling element; wherein said light engine has a source of radiant energy attached to said proximate side; wherein said source of radiant energy includes a light source selected from a low voltage AC lamp, high voltage AC lamp, DC lamp, fluorescent lamp, neon lamp, neon tube, neon light, light emitting diode, RGB array, RGBW array, ultraviolet diode, laser light emitting diode, luminescent panel, luminescent light, inductive lighting system, glow-in-the-dark phosphor element, and combinations thereof; wherein said mounting element, said coupling element and said light engine are interchangeably connectable to one another; and optionally, one or a plurality of sensors to detect one of an event selected from motion, proximity, sound and position of a user; wherein said sensor sends a signal upon such event to a controller device which then performs an operation; said operation being selected from turning said light engine on or off, controlling the intensity of said light engine, controlling the color emitted from said light engine, sending a control signal to another device, and receiving a control signal from another device, and combinations thereof.

Also disclosed herein are embodiments of an inventive magnetic positioning system for a modular lighting system comprising a mounting element; wherein said mounting element is configured to be removably attachable to a surface; wherein said mounting element has a first proximate side configured to attach to a receptive surface and a second distal side configured with a coupling interface to mate with a coupling element; wherein said coupling interface has a metal coupling aid that is subject to magnetic attraction; a coupling element, removably attachable to said mounting element; wherein said coupling element has a first proximate side configured to removably attach to said mounting element and a second distal side configured to removably attach to a light engine; wherein said proximate side of said coupling element has a magnetic bearing configured to mate with said coupling interface of said mounting element; wherein said magnetic bearing is magnetically attracted to said metal coupling of said mounting element; wherein the magnetic attraction between said metal coupling and said magnetic attraction exhibited by said magnetic bearing is strong enough to retain and maintain said mounting element and said coupling element in a closely mated position; wherein said magnetic bearing is configured to allow the relative rotation of said mounting element with said coupling element without disengagement of the mated configuration achieved when magnetically coupled; wherein said magnetic bearing may be in the shape of any rotational symmetric object selected from a sphere, toroid, donut, hemisphere, ring, disc, cylinder, ellipsoid, spheroidal segment, oblate spheroid, meniscus, and combinations thereof; and a light engine, removably attachable to said coupling element, wherein said light engine has a first proximate side configured to removably attach to said coupling element; wherein said light engine has a source of radiant energy attached to said proximate side; wherein said source of radiant energy includes a light source selected from, low voltage AC lamp, high voltage AC lamps, DC lamp, fluorescent lamp, neon lamp, neon tube, neon light, light emitting diode, RGB array, RGBW array, ultraviolet diode, laser light emitting diode, luminescent panel, luminescent light, inductive lighting system, glow-in-the-dark phosphor element, and combinations thereof; wherein said mounting element, said coupling element and said light engine are interchangeably connectable to one another.

Also disclosed herein are embodiments of an inventive parallelogram positioning system for a modular lighting system comprising a mounting element; wherein said mounting element is configured to be removably attachable to a surface; wherein said mounting element has a first proximate side configured to attach to a receptive surface and a second distal side configured with a means to mate with a coupling element; wherein said mounting element is selected from a mounting means capable of attaching to a flat horizontal surface, flat vertical surface, an edge or surface of an object selected from a cubicle wall, table, chair, computer monitor, display screen, keyboard, desk, pole and office equipment; a coupling element, removably attachable to said mounting element; wherein said coupling element has a first proximate side configured to removably attach to said mounting element and a second distal side configured to removably attach to a parallelogram positioning element; a parallelogram positioning element being a parallel configuration of two support elements; wherein a first proximate end of a first of said support elements is fixedly and rotatably attached to a said mounting element; and wherein a second distal end of the second of said support elements is fixedly and rotatably attached to a coupling element; wherein said support elements are constructed of a material or have an associated surface thereon that is strongly attracted to a magnetic force exhibited by a magnet; at least one or a plurality of magnetic elements; wherein said magnetic elements are either fixed in position with respect to one of said support elements or are configured to be slidingly engageable with one of said support elements; wherein said magnetic elements are positioned between said parallel support elements so as to be physically in contact with both of said support elements simultaneously; wherein the magnetic attractive force exhibited by said magnetic elements is strong enough to retain and maintain the relative positions of the said two parallel support elements with respect to one another; wherein said magnetic attractive force can be overcome by the application of an external mechanical force exhibited by a human user to change the relative position of said two parallel support elements with respect to one another; a second coupling element; wherein a first proximate side is connected to at least one distal end of at least one of said parallel support elements; wherein the second distal side of said coupling element is configured to be removably attachable to a light engine; a light engine, removably attachable to said coupling element.

Also disclosed herein are embodiments of an inventive parallelogram positioning system wherein said magnetic elements are fixed in position with respect to one of said support elements; wherein said two support elements are each fixedly and rotatably attached at both of their proximate ends to said mounting element; wherein said two support elements are fixedly and rotatably attached at both of their distal ends to said coupling element; and wherein said magnetic elements are fixedly attached to one or more of said support elements; and wherein said magnetic elements are configured to be slidingly engageable with the support element to which they are not fixedly attached; wherein said magnetic elements enable the distance between the said two support elements to vary as a function of the angle of said support elements as the support elements are moved with respect to a horizontal reference plane.

DESCRIPTION

Generality of Invention

Figure 1:
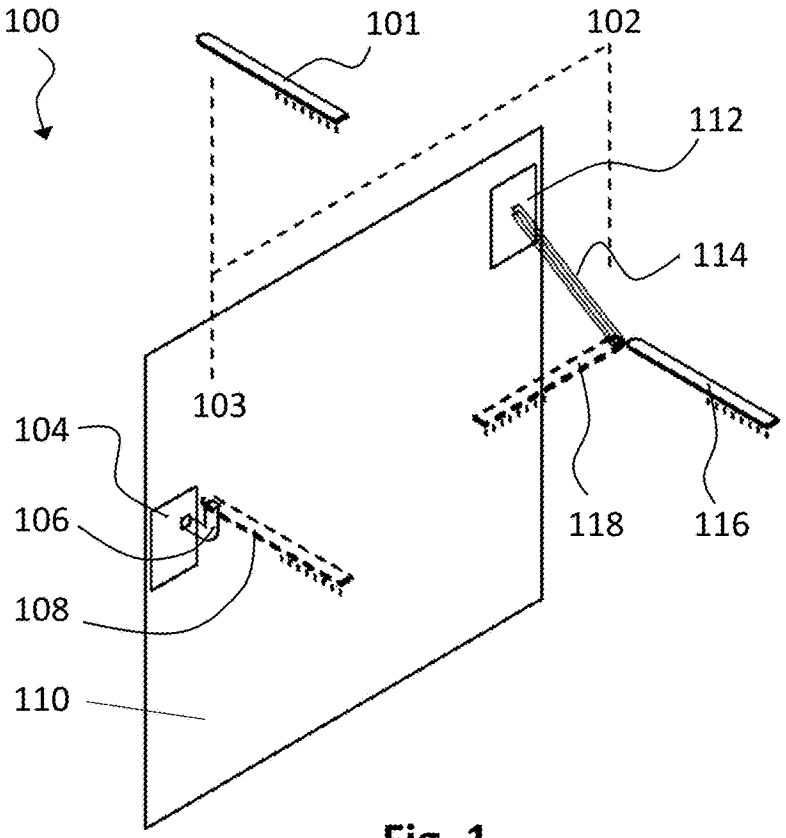
FIG. 1 shows several embodiments of a multimount lighting system featuring a reconfigurable light engine that can be mounted to any one of a flat or planar surface using a selection of mounting elements and coupling elements, and combinations thereof.

This application should be read in the most general possible form. This includes, without limitation, the following:

References to specific techniques include alternative and more general techniques, especially when discussing aspects of the invention, or how the invention might be made or used.

References to "preferred" techniques generally mean that the inventor contemplates using those techniques, and thinks they are best for the intended application. This does not exclude other techniques for the invention, and does not mean that those techniques are necessarily essential or would be preferred in all circumstances.

References to contemplated causes and effects for some implementations do not preclude other causes or effects that might occur in other implementations.

References to reasons for using particular techniques do not preclude other reasons or techniques, even if completely contrary, where circumstances would indicate that the stated reasons or techniques are not as applicable.

Furthermore, the invention is in no way limited to the specifics of any particular embodiments and examples disclosed herein. Many other variations are possible which remain within the content, scope and spirit of the invention, and these variations would become clear to those skilled in the art after perusal of this application.

Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

Lexicography

Read this application with the following terms and phrases in their most general form. The general meaning of each of these terms or phrases is illustrative, not in any way limiting.

The term "fixture" generally means a device for physically supporting an electrical component such as a luminaire, switch assembly, electrical outlet or other like devices.

The term "luminaire" generally refers to a lighting fixture which may include either a light source, a lamp, a reflector for directing the light, an aperture (with or without a lens), an outer shell or a housing for lamp alignment and protection, an electrical ballast (if required), and a connection to a power source.

The term "component" or "electrical component" generally means a device used to provide access to or control an electrical power system such a luminaire, a luminaire support, a switch, electrical outlet and like devices.

The term "receptacle" generally means a physical structure for receiving another physical structure through the use of an opening or protrusion.

The term "electrical receptacle", "power receptacle" and the like generally refer to receptacles whose primary function is to couple electrical energy.

The term "coupling", "coupling element", "connection means" and the like generally refer to a means to removably but fixedly connect two parts together, such means including typical fasteners such as for example, but not limited to, bolts, pins, rods, screws, magnets and combinations thereof.

Detailed Description

Specific examples of components and arrangements are described below to simplify the present disclosure. These are, of course, merely example embodiments of the invention and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

Multimount Configurable Lighting System

FIG. 1 shows several embodiments of a multimount lighting system 100 featuring a light engine 101 being an illumination unit with a source of light, coupled to various mounting elements in a variety of configurations, including a first mounting configuration 102 and a second mounting configuration 103 denoted by the configurations indicated by the doted lines.

In a first embodiment, a panel swing arm mount element 112 is removably attached to a flat accessible surface segment of a wall or panel section, such as for example, the panel section of an office partition or wall of an office, indicated as a vertical panel surface 110. In this embodiment, the light engine 116 is removably attached to one proximate end of a swing arm coupling element 114 on one end of said light engine 116, and the distal end of said swing arm coupling element 114 is removably attached to the panel swing arm mount element 112. An intercoupling means (not shown) between the light engine 116 and the swing arm coupling element 114 enables the free rotation of the light engine 116 with respect to said swing arm coupling element between a normal configuration 116 and the light engine in parallel configuration 118 with respect to the normal or perpendicular axis of the vertical panel surface 110. In this embodiment, the adjustable swing arm coupling element 114 is configured to enable its angle of attachment with respect to the panel swing arm mount element 112 to be adjusted at will from a nearly vertically oriented upward direction to a nearly vertically oriented downward direction, depending on the mechanical limitations of said swing arm coupling element 114, which combined with the free rotation of the light engine 116 with respect to the swing arm coupling element 114, enables the light engine to be positioned and repositioned amongst a wide variety of configurations and angles with respect to the vertical panel surface 110.

Means to attach the mounting elements 104 and 112 to a surface include both removable means such as bolts, screws, pins, Velcro™ and the like, as well as more permanent, non-removable means such as adhesive, double-sided tape, glue, non-removable fasteners and those requiring a special tool for removal after placement. Alternative, semi-permanent attachment means are also possible and include removal adhesives and removal adhesive tapes, such as the Scotch® Removable Mounting Tape, available from 3M Company, 3M Corporate Headquarters, 3M Center, St. Paul, Minn. 55144-1000, USA.

In a second embodiment, a panel mount element 104 is removably attached to a flat proximate surface of a wall or panel segment, such as for example, the panel segment of an office partition, indicated as a vertical panel surface 110. In this second embodiment, light engine 108 is mounted to a fixed 90° elbow coupling element 106 by means of an intercoupling element (not shown) that operates to hold said light engine in a substantially horizontal position but further operates to enable the rotation of light engine 108 about an axis normal to said elbow coupling element 106 and passing through said intercoupling element and the portion of said light engine 108 that is removably attached to said elbow coupling element 106 by means of said intercoupling element. Accordingly, light engine 108 can be positioned to extend normally outward with respect to the vertical panel surface 110 or positioned in either one of two essentially parallel configurations with respect to 110, or positioned at an intermediate angle with respect to 110, said intermediate angle lying between the two extreme and opposite parallel configurations (not shown). In this embodiment, the fixed 90° elbow coupling element 106 is fixed in position with respect to the panel mount element 104, even though it is reversibly attachable to the surface of said panel mount element 104.

Figure 2:
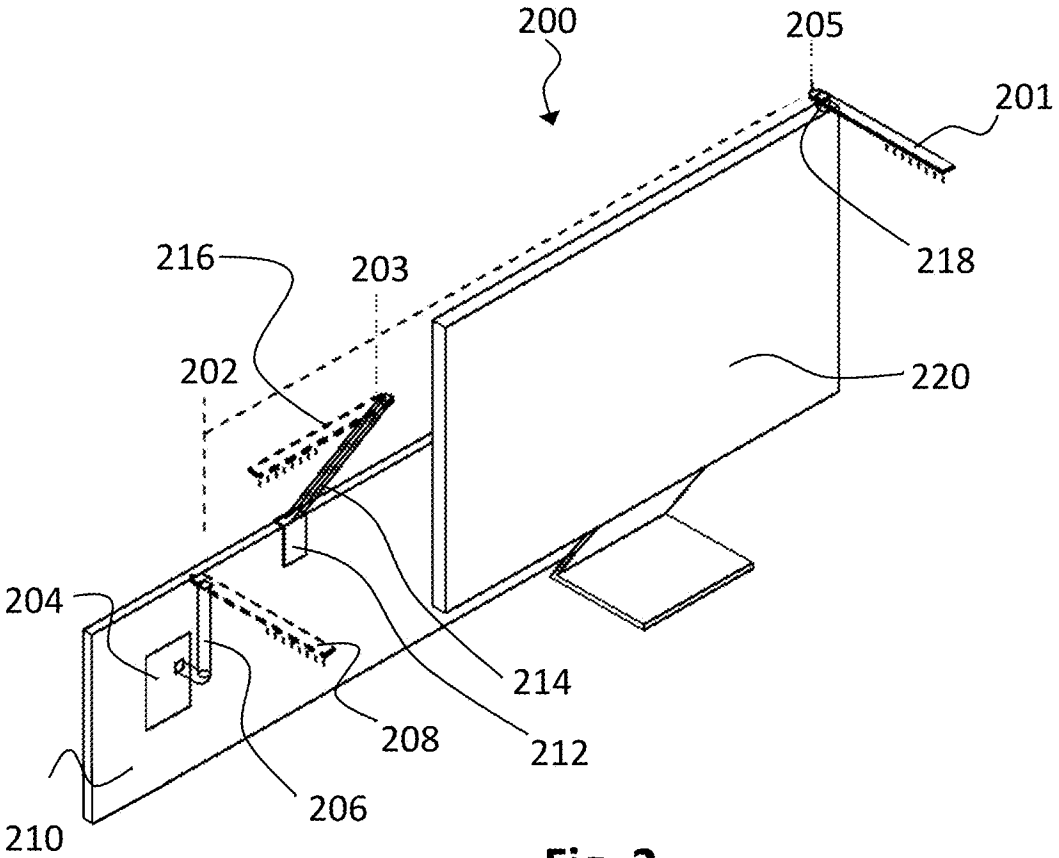
FIG. 2 shows several embodiments of a multimount lighting system featuring a reconfigurable light engine that can be mounted to any one of a flat vertical surface or to an edge of a panel using a selection of mounting elements and coupling elements, and combinations thereof.

FIG. 2 shows additional embodiments of a multimount lighting system 200 featuring a light engine 201 in various mounting configurations and orientations, including a first mounting configuration 202, denoted by the leftmost dotted line, in which a panel mount element 204 is reversibly and detachably secured to the vertical surface of a vertical panel surface 210, and which is coupled to a fixed 90° long elbow coupling element 206 which in turn is reversibly and detachably secured to one end of a light engine 208, shown in an orientation in which the light engine 208 is positioned to extend outward in a normal orientation with respect to the panel surface 210, coupled to the long elbow coupling element 206 by means of a swiveling interconnection element (not shown) that enables the light engine 208 to be repositioned to any suitable rotation angle with respect to the fixed direction of said element 206, whose position with respect to the panel mount element 204 is fixed, but optionally is initially adjustable by means of an attachment mechanism between 204 and 206 (not shown) to any desired fixed position, such attachment mechanism being selected from, but not limited to, a screw, bolt, adhesive patch, pin, threaded coupling, joint, bearing, or any combination thereof serving to provide an attachment means sufficient to hold the long elbow coupling element 206 in a desired position and orientation.

An additional embodiment is shown featuring a second mounting configuration 203, denoted by the center dotted line, in which one end of a light engine 216 is reversibly and detachably secured to a first proximate end of a swing arm intercoupling element 214 wherein the second distal end of 214 is reversibly and detachably secured to a panel top swing arm mounting element 212, which is attached to the top edge portion of the vertical panel surface 210. Two intercoupling junctions (not shown) located on the distal and proximate ends, respectively, of the swing arm intercoupling element 214 provide for the free rotation of 214 with respect to the panel top swing arm mounting element 212 and the light engine 216, respectively. In this embodiment, the light engine 216 is shown in a parallel configuration with respect to both 216 and 212, but may be freely rotated about the connection axis between the light engine 216 and the proximate end of the swing arm intercoupling element 214 to any desired relative rotation angle between approximately 0 to 360°. Further, in this embodiment, the relative angle of rotation between the distal end of 214 with respect to the panel top swing arm mounting element 212 can also be freely selected to any desired relative rotation angle between approximately 0 to 360°, enabling the second mounting configuration 203 to assume a wide variety of relative positions of the light engine with respect to a working surface located near to the vertical panel surface (not shown). In addition, the swing arm intercoupling element 214 is adjustable with respect to a common angle of declination between the light engine 216 and the top of the panel top swing arm mounting element 212, having internal means disclosed hereinbelow to maintain the plane or horizontal position of the light engine 216 in any desired parallel position with respect to 212 as the swing arm intercoupling element 214 is extended between a first closed position (not shown) to a second intermediate open position (as approximately shown in the second mounting configuration rendering) and then to a fully extended position (not shown), in which the swing arm intercoupling element 214 is positioned in a vertical orientation extended straight upwards along an axis normal to the top surface of element 212.

Also shown in FIG. 2 is yet another embodiment showing a third mounting configuration 205, denoted by the left most dotted line, in which light engine 201 is attached to the top surface edge of a computer monitor flat panel display 220 by means of a monitor swivel mount and coupling element 218 connected to a first proximate end of 220, wherein the combined monitor swivel mount and coupling element 218 operates to hold the light engine 201 in horizontal position relative to the plane of the surface (not shown) on which 220 is positioned, being at right angles to the plane of the front viewing surface of 220. In this embodiment, the light engine 201 is reversibly attached to the top of the computer monitor flat panel display 220 by means of monitor swivel mount and coupling element 218, which serves the dual purpose of providing a reversible attachment means to the top surface of 220, and a freely rotatable and positionable coupling means with the light engine 201, so that the latter can be rotated to any desired relative rotation angle between approximately 0 to 360° with respect to a common axis passing through the common axis of rotation connecting 218 to the top surface of 220.

Figure 3:
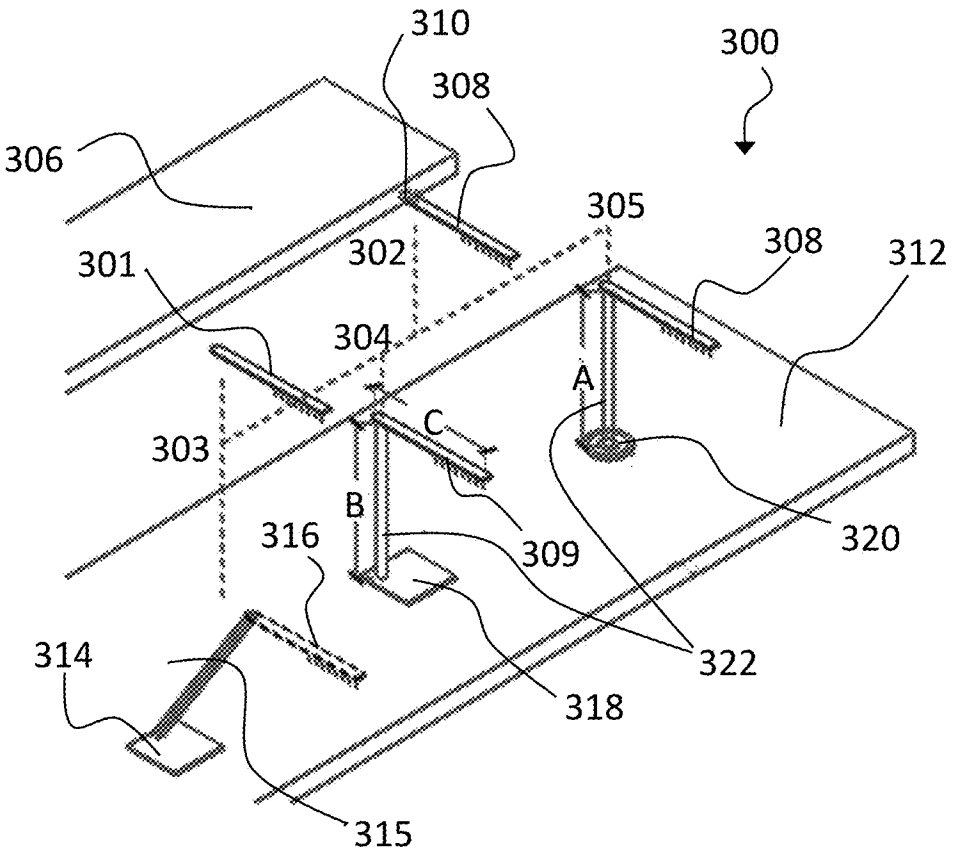
FIG. 3 shows several embodiments of a multimount lighting system featuring a reconfigurable light engine that can be mounted to any one of a flat horizontal surface using a selection of mounting elements and coupling elements, and combinations thereof, including swivel means to rotate the position of said light engine.

FIG. 3 shows additional embodiments of a multimount lighting system 300, in which a light engine 301 can be reversibly and detachably coupled to a variety of coupling elements and mounting elements to achieve a large number of possible configurations. In a first mounting configuration 302, denoted by the center dotted line 302, a light engine 308 is attached by means of an undershelf swivel mount and coupling element 310 to the bottom flat surface of an overhead shelf 306. In a second mounting configuration 303, denoted by the leftmost dotted line, a light engine 316 is coupled to a desk top swing arm mount 314 by means of a swing arm intercoupling element 315, which has means (not shown) to adjustably pivot at a first proximate connection point between 314 and 315, as well as means (not shown) to adjustably pivot at a second distal connection point between 315 and the light engine 316, which is shown pivoted at an angle of approximately 45° with respect to an axis extending normally from the upper surface of the desk top 312 upon which the desk top swing arm mount 314 is reversibly attached.

In a third mounting configuration 304, denoted by the middle dotted line, a light engine 309 of length C is connected to a vertical riser coupling element 322 of height B, the latter reversibly coupled to a desk top fixed mount element 318, which in turn is reversibly attached to the upper surface of the desk top 312. In this third mounting configuration 304, the interconnection means (not shown) between the light engine 309 and the vertical riser coupling element 322 can be configured to be rotatable about the axis passing through the center of 322 along its direction of height, B, thus enabling the positioning of the light engine 309 to any desired angle of between 0 to 360°, with respect to a starting angular position. In an alternative embodiment, the interconnection means (not shown) between the light engine 309 and the vertical riser coupling element 322 can be configured to be fixed, so that the light engine 309 cannot rotate, so that the overall configuration of the third mounting configuration 304 is that shown in FIG. 3, the positions of the three elements, 308, 318 and 322 being locked in place with respect to each other.

Also shown in FIG. 3 is a fourth mounting configuration 305, denoted by the rightmost dotted line, featuring a light engine 308 reversibly attached to vertical riser coupling element 322 of arbitrary height A, the vertical riser coupling element 322 in turn being reversibly attached to a desk top swivel mount element 320, the latter having a swiveling means enabling the assembled 308 and 322 elements to be freely rotatable about the axis passing through the center of 322 along its direction of height, A. In this instant embodiment, the light engine 308 can be fixedly attached to the vertical riser coupling element 322 and thus not freely rotatable with respect to 322, but by virtue of the desk top swivel mount element 320, the light engine 308 can be rotatably positioned by means of the rotation mechanism (not shown) in 320 between any desired angle of between 0 to 360° with respect to a starting angular position, rotation being enabled by means of the rotation means in the base, or desk top swivel mount element 320.

In additional embodiments, the detachable swiveling elements, coupling elements and mounting elements described herein are all interchangeable with one another, allowing any desired combination of these elements to be made and exchanged, for example a desk top mounting element serving as a base, connected with a fixed coupling element serving as a standoff or riser, connected in turn to a swiveling element mounted on a light engine, or alternatively the fixed coupling element connected directly to the light engine, providing a freely rotating lighting system and a fixed, non-rotating lighting system, respectively.

In related embodiments, a light engine can be attached to any vertical or horizontal surface, or an edge of a vertical or horizontal object, or to the top or bottom of a horizontal surface by means of selecting the appropriate mounting element, and coupling said light engine to said mounting element by one or more attachment means as disclosed herein.

In further embodiments, the light engine may include one or a plurality of remote sensor means to detect the approach, motion and/or proximity of a user, said sensor means interacting with an electronic control means to operate to turn the lighting system on and off. In related embodiments, one or more of a motion, proximity and position sensor can also be employed to enable the user to control the light intensity and color mixing of light emitted by the inventive device by means of moving an appendage, such as a hand or finger, in a predetermined direction or orientation, so as to signal the proximity and/or position sensors of said motion, wherein said electronic control means acts to interpret said motion and then operates to adjust the light intensity and color mixing in response to the user's motion.

Magnetic Positioning System

Figure 4:
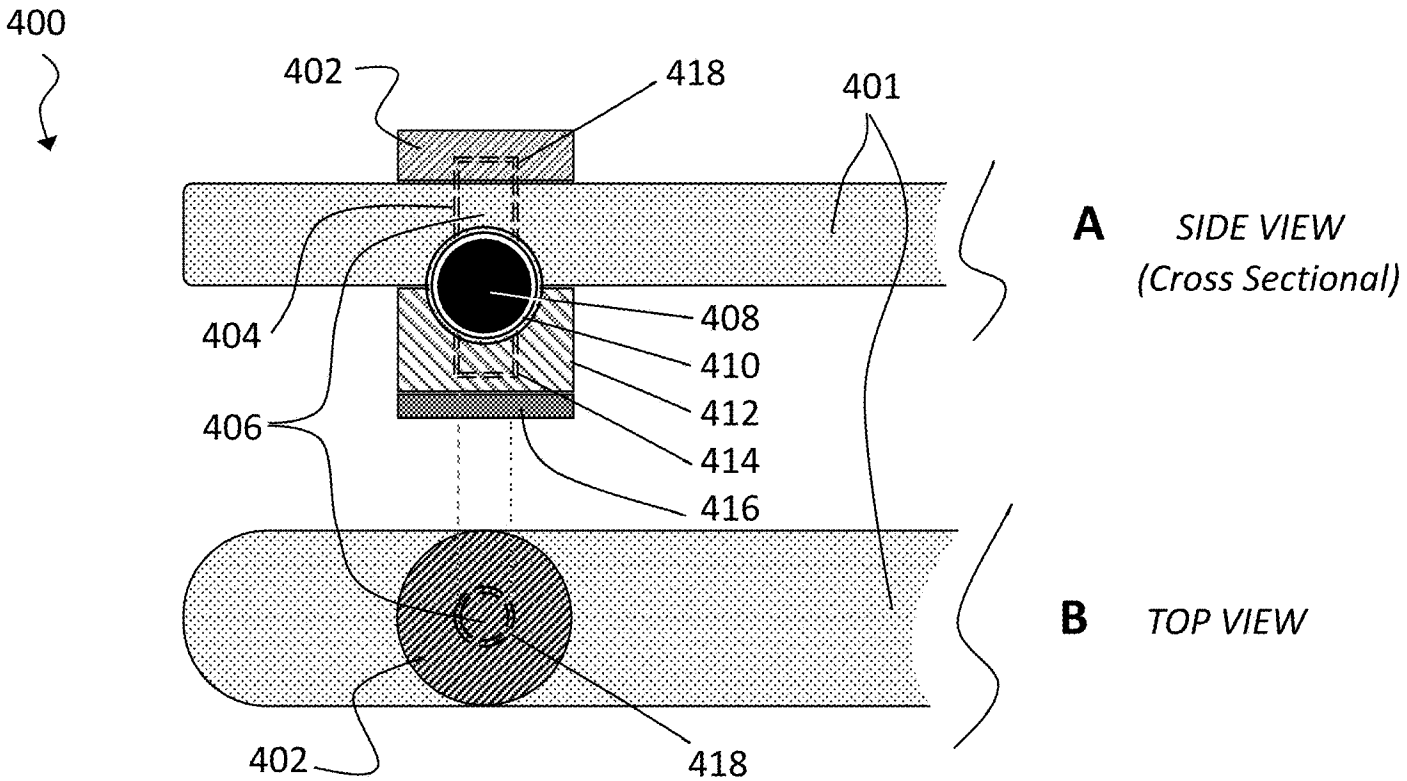
FIG. 4 shows a side cross-sectional cutaway view and a top view of an embodiment of a magnetic ball coupling element enabling the free rotational positioning of a light engine about the attachment axis.

FIG. 4 shows a side cross-sectional cutaway view "A" and a top view "B" of an embodiment of a magnetic mounting means to secure a light engine 401 (only one end shown) to a swivel joint assembly. In this embodiment, the light engine 401 has a top fastener element 402 with a top swivel pin receptacle 418 securing a swivel pin 406 that passes through the light engine element through a swivel joint or bore hole 404 that provides clearance for a swivel pin 406 that passes through a magnetic ball joint 408 and is secured into a swivel pin receptacle 414 in the lower section of the swivel joint comprising elements 412 and 414, which is preferably constructed in this embodiment of a ferrous or magnetically attracted metal that responds to magnetic force or attraction. A magnetic ball joint 408 mates with a ball joint receptacle 412, being a semi-spherical void in the lower section of the swivel joint, a corresponding semi-spherical void being present in the lower (bottom) side of said light bar 401, the two combined forming a roughly spherical void of a size and geometry that accommodates the magnetic ball joint 408 in a tight but moveable manner enabling the swivel joint to pivot about a common axis passing through the light bar, magnetic ball joint and lower section of the swivel joint, so that the light bar can be movably positioned around that axis, and owing to the magnetic force of attraction between the magnetic ball joint 408 and the ferrous or metal ball joint receptacle 412, be magnetically held in position by said magnetic force, but easily repositioned by applying a stronger manual force to move the light bar to a new desired angle or position, wherein the magnetic force operates again to hold the light bar in said second new desired angle or position. In the embodiment shown in FIG. 4, the upper drawing denoted by "A" shows the side cross sectional cutaway view of the light bar and magnetic swivel means discussed above, while the lower drawing "B" shows the top view of the light bar 401, showing the top fastener element 402 and in dotted line the rotation axis represented by the position of the swivel pin 406 located within the swivel joint bore 404 that is common to the light engine 401 and the bottom ball joint receptacle 412.

In a related embodiment, an optional ball joint liner 410 can be used either as a coating on the magnetic ball joint 408, a coating on the semi-spherical surfaces of said spherical void spaces in said light engine element 401 or said lower section of the swivel joint, or on both, or as a separate element that serves to reduce friction between the magnetic and the ball joint receptacle, by preventing direct physical surface to surface contact between the latter two elements. In a related embodiment (not shown) the magnetic element 408 can be a disc or donut shaped magnet with a center bore, rather than a sphere.

In a further embodiment, the lower or bottom side of the bottom ball joint receptacle 412 has an additional attachment element 416 that provides a means to connect the assembled light engine 401 to a support member or other element of the present invention, as disclosed herein.

Figure 5:
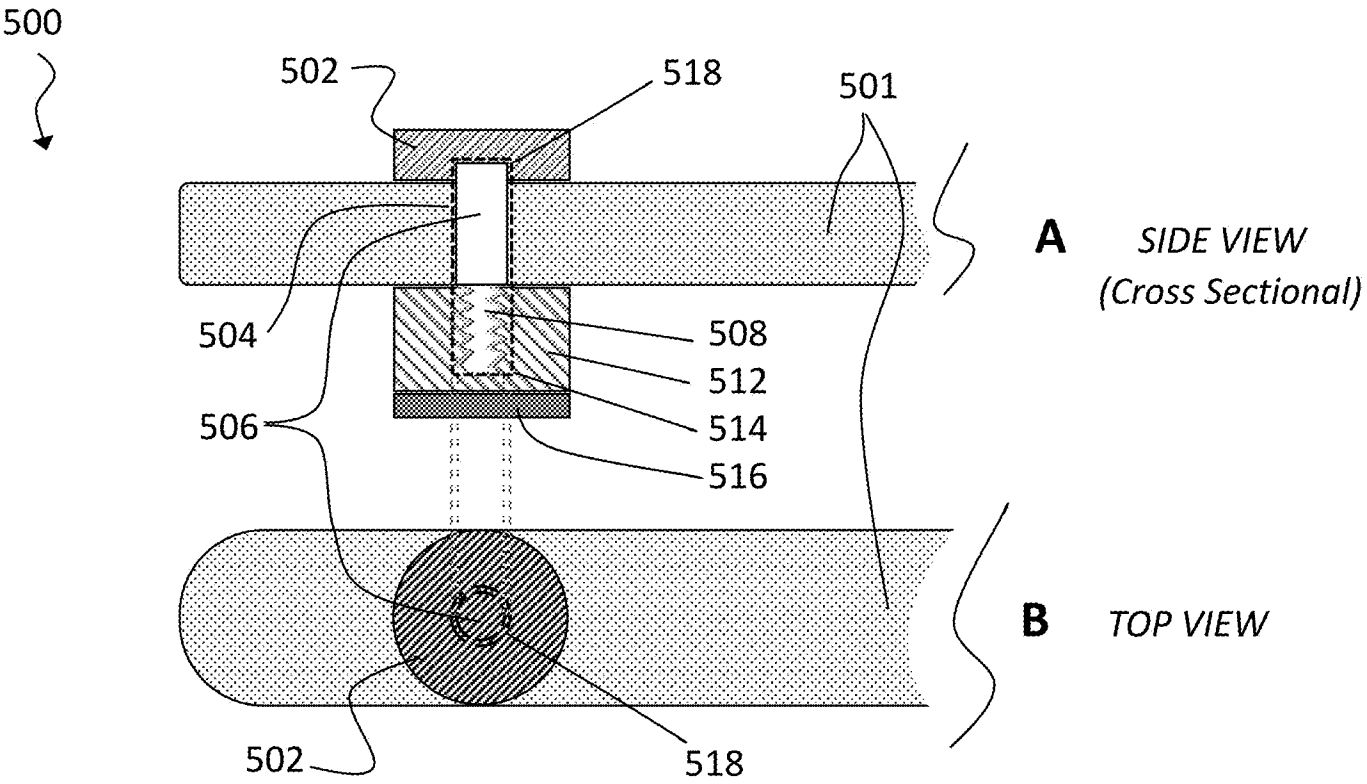
FIG. 5 shows a side cross-sectional cutaway view and a top view of an embodiment of a machine bolt coupling element enabling the free rotational positioning of a light engine about the attachment axis.

FIG. 5 shows a side cross-sectional cutaway view "A" and a top view "B" of an embodiment of a machine bolt coupling element as one representative attachment means 500 enabling the free rotational positioning of a light engine 501 about the attachment axis, being the common axis passing through the top fastener element 502 through the swivel bolt with threaded connector 506. Here the swivel bolt with threaded connector 506 has a smooth upper shank section that fits snugly within the swivel joint bore 504 in the light engine 501, but which enables free rotation of the assembled unit about the axis. The swivel bolt 506 has a lower threaded bolt portion 508 that threads into and mates with threads present in the bottom threaded receiver 512, securing the two into position with the light bar 501 sandwiched between, but movably so by means of adjusting the bolt tension to be low enough to allow manual manipulation and rotation of the light bar around the pivot axis by manual force of a user. In this embodiment, the bolt tension is selected to maintain the light engine 501 in the desired position. In a related embodiment, the bottom threaded receiver 512 has a bolt receptacle 514, being a bore-out or clearance area that enables the swivel bolt connector 506 to be threaded to the desired tension without bottoming out in the bore of the bottom threaded receiver 512. In a related embodiment, the bolt receptacle 514 can instead have a compressible material of size corresponding to the bore diameter and approximate clearance depth, so that the bottom face of the threaded bolt portion 508 presses against it creating a springing tension force to prevent rotation of the swivel bolt 506 during rotation of the light engine 501 with respect to the bottom threaded receiver 512, thus acting as a means to prevent loosening of the swivel bolt 506 over time.

In a further embodiment, the lower or bottom side of the bottom ball joint receptacle 512 has an additional attachment element 516 that provides a means to connect the assembled light engine 501 to a support member or other element of the present invention, as disclosed herein.

In the embodiment shown in FIG. 5, the upper drawing denoted by "A" shows the side cross sectional cutaway view of the light bar and threaded swivel means discussed above, while the lower drawing "B" shows the top view of the light bar 501, showing the top fastener element 502 and in dotted line the rotation axis represented by the position of the swivel pin 506 located within the swivel joint bore 504 that is common to the light engine 501 and the bottom threaded receiver 512.

Figure 6:
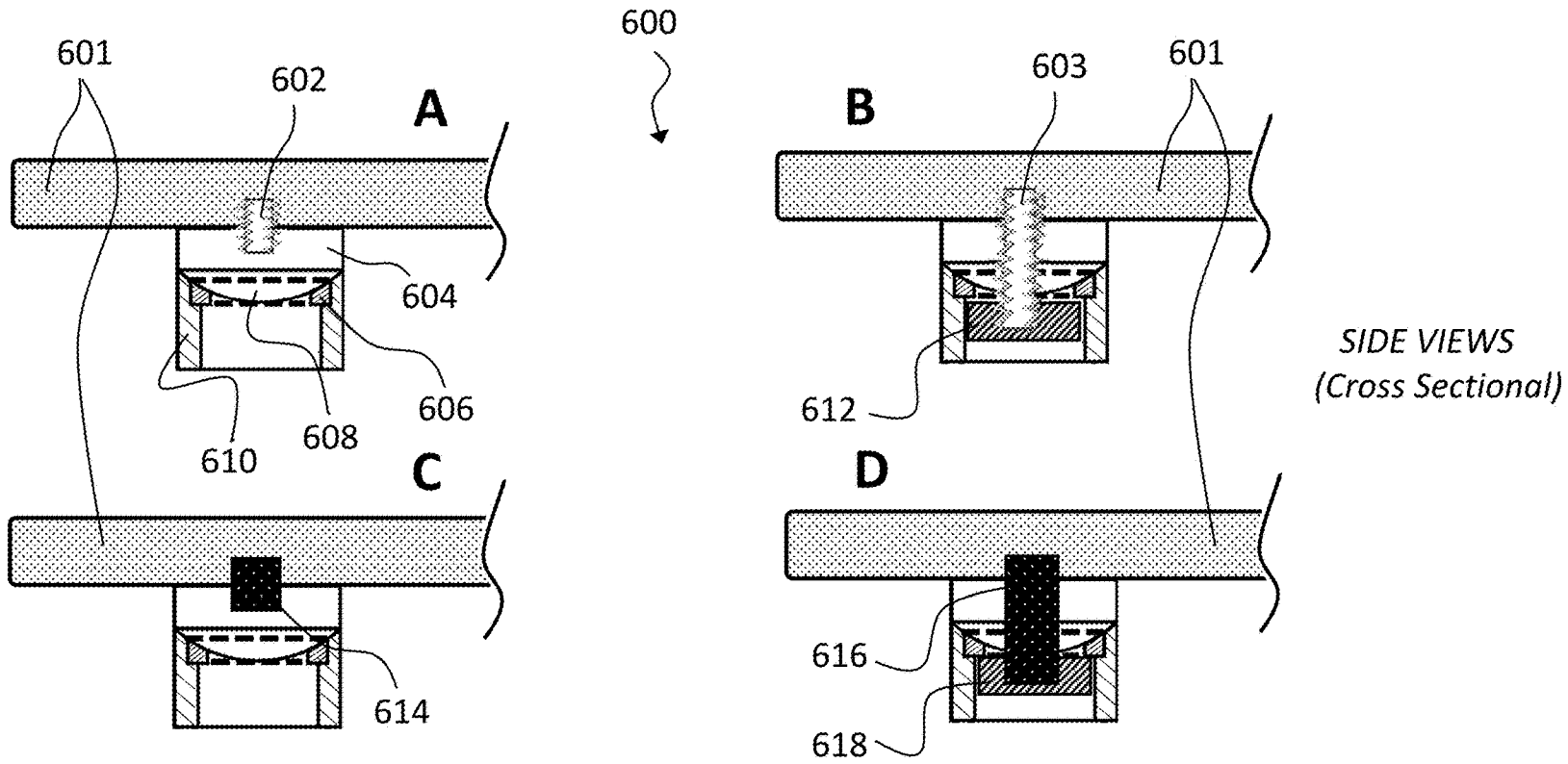
FIG. 6 shows four side cross-sectional cutaway views of embodiments of a magnetic ring coupling element, with removable and non-removable securing elements enabling the free rotational positioning of a light engine about the attachment axis.

FIG. 6 shows four side cross-sectional cutaway views of embodiments of a magnetic ring coupling element, with removable (A and C) and non-removable (B and D) securing elements enabling the free rotational positioning of a light engine about the attachment axis, which passes through the center of the attachment means elements, as disclosed below. In embodiment 6A, a threaded attachment means 602, shown here as a threaded screw segment, serves to connect the light bar 601 with the swivel magnetic joint element 604, which can either be ferrous in nature, or optionally have a lower ferrous magnetic joint attractor element 608, either of which are magnetically attracted to, and which thus provides a means to magnetically mate with the magnetic ring 608 present in the lower bottom magnet receiver 610, which in this embodiment is a ring shaped magnetic element with a fractional semi-spherical upper surface whose negative curvature corresponds to the positive curvature of the ferrous magnetic attractor joint 608, providing a close fitting joint about which the light engine 601 can turn without wobbling or moving out of the horizontal plane as it rotates about the attachment means axis. Because the threaded attachment means 602 only secures the swivel magnetic joint element 604, this embodiment allows the upper light engine assembly, being the connected 601 and 604 elements, to be manually removable from the bottom magnetic receiver 610, so that light engines can be replaced or exchanged at will without the need to remove a connection means.

In contrast, in embodiment 6B, a longer thru-threaded attachment means 603 passes through the swivel magnetic joint element 604 and socket into either a threaded portion in the bottom magnetic receiver 610 (not shown) or into a bottom threaded receiver 612 that is positioned within an open region on the bottom side of element 610, so as to secure the entire assembly together in a threaded fashion.

In a more generalized set of embodiments shown as 6C and 6D, an alternative connection means other than a threaded attachment means is employed, being any acceptable connection means known in the art or as disclosed herein, that functions to secure the indicated connected pieces together either in a removable or permanent fashion. Accordingly, in embodiment 6C, the upper light engine assembly of 610 and 604 can be removed from the lower bottom magnetic receiver 610, in a similar fashion as with embodiment 6A, being secured with a short attachment means 614. In contrast, embodiment 6D secures the upper light engine assembly to the lower swivel joint assembly using a long attachment means 616 that passes through the two elements, so that they cannot be easily separated without the use of some tool or force, if the long attachment means 616 and attachment means receiver 618 is configured to be removable.

Parallelogram Positioning System

Figure 7:
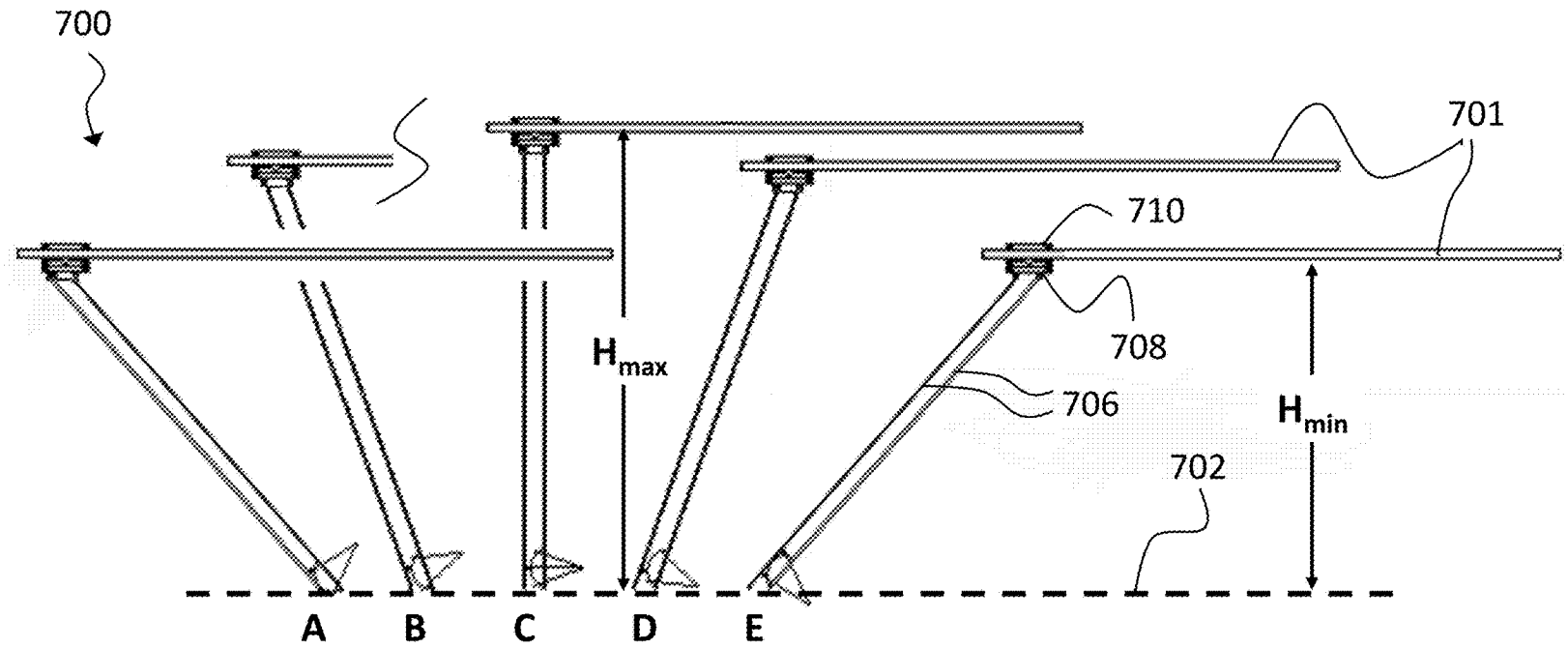
FIG. 7 shows an illustration of several side views of one embodiment of a parallelogram style coupling element holding a light engine at various angles (A-E) with respect to a reference surface.

FIG. 7 shows an illustration of several side views of one embodiment of a parallelogram style positioning member that joins to a coupling element on a light engine 701 or to a surface mounting element (not shown) as disclosed hereinabove, which enables the light engine 701 to be movingly positioned and repositioned to any desired height or angle from approximately −45° (position A) to +45° (position E) with respect to the normal vertical or fully upright position C. In these embodiments shown, the parallelogram light engine 701 can be adjusted to any angle from approximately −30° to +30° degrees (not shown), the angle depending on the particular nature of the swivel joint or coupling element 708 employed that attaches to the parallel support arms 706 by some securing means 710 or other means of removably or fixedly attaching said light engine to said coupling element 708, which can either act to fix the rotational position of the light engine 701 or include rotational means to enable the light engine 701 to swivel about an attachment axis common to elements 708 and 710 (not shown).

FIG. 7 shows one embodiment in which a light engine 701 is hingedly connected to a set of two parallel support arms 706 that are tensioned by some means, such as for example, but not limited to, a spring force, magnetic force, frictional force, tensional force and the like, so that the parallel support arms 706 tend to remain in any position at which they are maneuvered by a user applying manual force to the assembly. Accordingly, the light engine 701 can be positioned over a series of angles with respect to the plane surface 702 shown as a reference, having a maximum height or horizontal position ($H_{max}$) at position C when the light engine 701 is positioned in an approximately normal or fully vertical position with respect to the two parallel support arms 706. The light engine 701 can be positioned at an angle, being the maximum deflection angle achievable depending on the means used to attach and secure the two parallel support arms, at some angle such as that shown as position E, at which position the light engine 701 is at its lowest height or horizontal position ($H_{min}$), being at an approximate 45° degree angle. In related embodiments, the maximum and minimum angles can differ, as well as the maximum and minimum height, depending on the separation between the two parallel support arms, and the nature of the on the means used to attach and secure the two parallel support arms as well. Accordingly, one object of the parallel support arms is to enable positioning of a light engine in at any desirable height and at any desirable angle, while automatically maintaining the horizontal orientation of the light bar with respect to the attachment surface, or surface on which the light bar and parallel positioning system is located.

Ideally, only a moderate applied manual force, such as that easily exerted by a human digit, such as a finger or hand, is required to position and reposition the parallel positioning system between a first and a second, final position, while the parallel positioning system can retain itself in said final position indefinitely countering the force of gravity.

Figure 8:
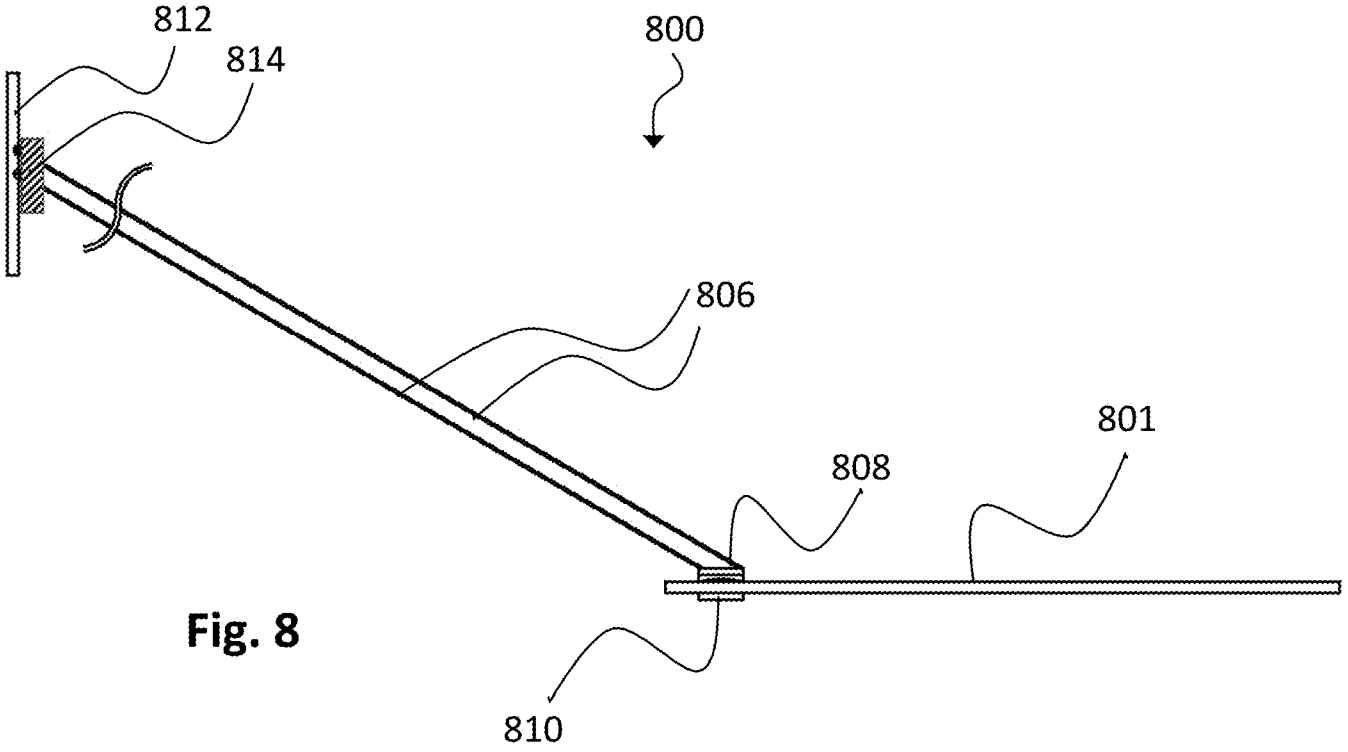
FIG. 8 shows an illustration of one embodiment of a parallelogram style coupling element holding a light engine wherein the coupling element is attached to a vertical surface.

FIG. 8 shows an illustration of one embodiment of a parallelogram style positioning system 800 holding a light engine 801 wherein the coupling element is a horizontal mounting means 814 that enables the system to be securely attached to a vertical surface 812. In this embodiment, a set of parallel support arms 806 are attached on one distal end to the horizontal mounting means 814 so that they can swivel in the same manner as disclosed above in the embodiments of FIG. 7, and also attached to one the proximate end to a coupling element 808 that is secured to the light engine 801 by means of a securing means 810, according to one or more embodiments as disclosed herein. The coupling element 808 also has a means to enable the parallel support arms 806 to swivel, the means enabling the light bar 801 to be repositioned at any desired angle or desired height or position with respect to the vertical wall surface 812 or a horizontal surface or work area (not shown) desired to be illuminated.

Accordingly, this and other embodiments of the inventive parallelogram positioning system enable a light engine to be mounted to a vertical, horizontal or other attachment surface, such as an edge or other suitable surface, and be repositioned at will by a user using nominal applied force.

Figure 9:
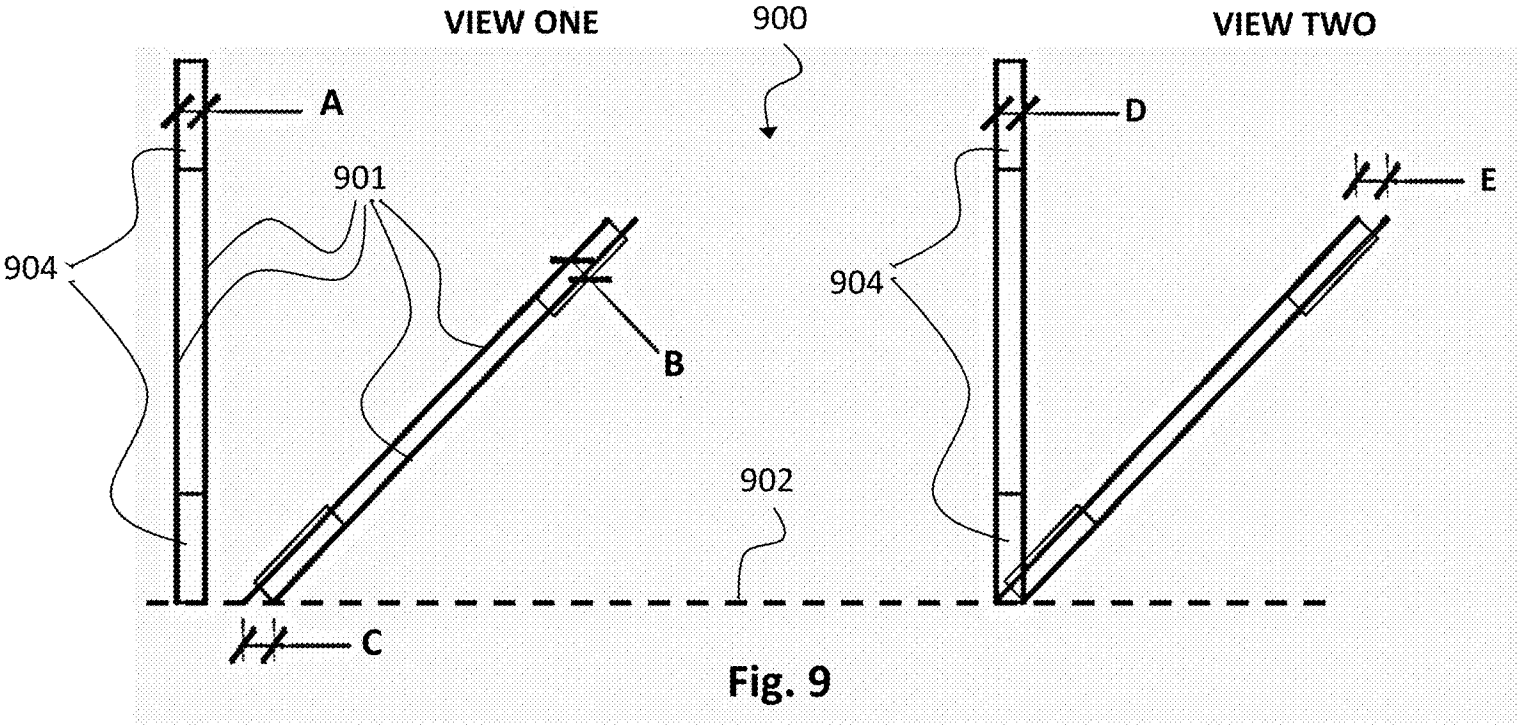
FIG. 9 shows an illustration of one embodiment of a parallelogram style coupling element with a sliding magnetic positioning means that retains the initial parallel separation distance as the parallelogram style coupling elements are repositioned from a first to a second angular position.

FIG. 9 shows an illustration of one embodiment of a parallelogram positioning system 900 using at least one or a plurality of sliding magnets 904 as a magnetic positioning means that serves to releasably secure the two parallel support arms 901 in a selected position or relationship with each other, using the magnetic attractive force of the magnet 904 to attract at least one of the parallel support arms, which accordingly is either made in one embodiment from a ferrous material or other material that is magnetically attracted. In an alternative embodiment, the parallel support arms may be made of a non-magnetically attracted material, and an added ferrometallic assist element 906 (not shown) can be incorporated on a surface of said parallel support arms near the magnet elements 904 so that the assist element 906 is securely attached to said parallel support arm and itself is magnetically attracted to the magnet elements 904, rather than the parallel support arm. In related embodiments, suitable ferrometallic assist elements 906 can be selected from, for example, but not limited to, a strip of iron or ferrous alloy, strip magnet or magnetic coating, or ferrous coating or element securely attached to one or more surfaces of the parallel support arm at a position to interact with said one or plurality of sliding magnets 904.

In the embodiments shown and relating to FIG. 9, the sliding magnet 904 design and configuration, discussed herein below in greater detail, enables the distance between the two parallel support arms 901 to vary as the relative angle of the arms is changed with respect to the horizontal plane 902 or reference surface, when each of the two parallel support arms 901 are attached to a point on said surface. As a function of geometry and trigonometry, two upright parallel elements, such as the two parallel support arms 901, when attached to two fixed but rotatable points at one end, as shown in FIG. 9 with the lower or proximate portion of each arm 901 fixedly secured to the plane surface 902, will have an initial distance of separation as shown as measurement A in View One. Upon changing of the angle of the two arms 901, the separation distance narrows to measurement C, the distance between the parallel support arms 901 being reduced to an extent depending on the angle of declination, resulting in the relative displacement of a point on the upper or distal portion of each arm 901 by a distance denoted by measurement B. Accordingly, by means of a sliding magnet or a means enabling the magnet to move in compensation for the reduced distance between the two parallel support arms 901, the parallelogram positioning system in these and related embodiments as shown in FIG. 9 enable the parallel support arms 901 to be moved and repositioned to any desired angle or position, the sliding magnet 904 or plurality of magnets providing an attractive force to hold the two support arms in the desired relative position with respect to one another, while also compensating for the varying separation distances between the two said support arms 901 as their relative angle or inclination is changed.

In View Two, the lower or proximate ends of the parallel support arms 901 are shown at their original attachment points, so that the change in the distance of separation, shown as measurement E, can more readily be seen, noting also that the position of one or more of the parallel support arms 901 has changed with respect to the original position associated with the two magnets 904 shown, a first magnet located near the proximate end and the second magnet located near the distal end of the parallel support arm mechanism. In this embodiment, the lower or proximate magnet is securely attached to the right most parallel support arm, so that the left most parallel support arm is observed to move in relative position, while the upper or distal magnet is securely attached to the left most parallel support arm, so that the right most parallel support arm is observed to move in relative position to the upper magnet. In other embodiments, any one or a plurality of magnets can be fixedly attached to one or both of the parallel support arms 901, serving to function in a similar manner, providing that they are fixedly secured to at least one of the arms 901 while magnetically and slidingly attracted to and engageable with the second parallel support arm 901 of the pair.

Figure 10:
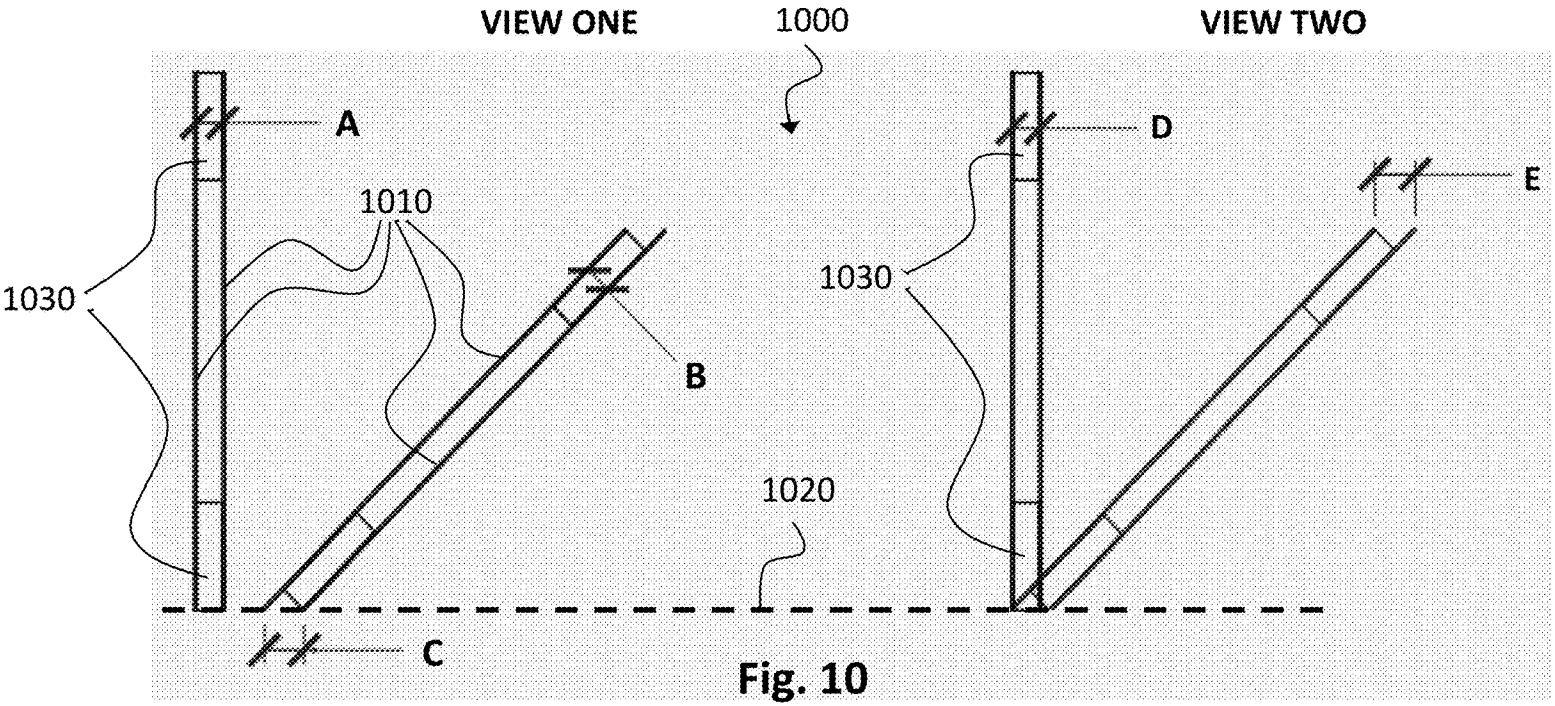
FIG. 10 shows an illustration of one embodiment of a parallelogram style coupling element with a fixed magnetic positioning means with one fixed and one movable parallelogram support element, wherein the parallelogram components move with respect to one another as they are repositioned from a first to a second angular position.

FIG. 10 shows an illustration of one embodiment of a parallelogram positioning system 1000 with a fixed magnetic positioning means being a fixed magnet 1020 or plurality thereof secured to one parallel support arm 1010 with the second of the paired parallel support arms 1010 being movable in respect to one another as they are repositioned from a first to a second angular position, with respect to a plane surface 1020 or horizontal reference.

In this embodiment, only one of the parallel support arms is fixedly connected to a lower or proximate point in a fixed but rotatable point at the surface 1020, while the second is not fixed, although it may be secured if desired by some slidingly maneuverable means allowing its angle and position to change freely as necessitated by a change in angle of the parallelogram positioning system 1000. In this embodiment, the upper or distal end of the second parallel support arm 1010 of the pair is fixedly but rotatably connected to a point on the bottom of a light engine (not shown). In this configuration, the one or more fixed magnets 1030, act to attract the two parallel support arms and thus act to keep them magnetically attracted to the two opposite sides of the fixed magnet 1030, by enabling the relative vertical displacement of one of the parallel support arms 1010 to change with respect to the other, so that geometrically, the spacing between the said two arm remains the same at all angles and configurations. Accordingly, the initial spacing between the parallel support arms 1010 as shown in View One is the measurement A, which remains constant as the parallelogram positioning system 1000 is moved to an approximate 45° angle with respect to its initial, normal or horizontal position, the spacing between the parallel support arms 1010 being measurement C, which is the same as C, although the change in angle has resulted in a slight relative displacement of the ends of the two parallel support arms 1010 being the measurement B, which actually shows the total displacement, as both the lower or proximate end of the right most parallel support arm, as well as the upper or distal end of the right most parallel support arm has moved upward slightly, as a function of the angle and as a function of trigonometry wherein the two parallel support arms are secured magnetically to maintain a constant separation between them as their angular positions relative to the plane surface 1020 is changed.

In related embodiments, either one of the two parallel support arms 1010 need be fixedly attached at either end, while the other is not, being either fixed at a first proximate lower end or a second distal upper end. Further, in related embodiments, the one or plurality of fixed magnets 1030 can be attached to either one or both of the parallel support arms 1010, being attached to either arm at any position, providing that at least one surface of each fixed magnet 1030 remains unattached to a second parallel support arm, so that that fixed magnet can slidingly engage with the unattached second parallel support arm to enable it to adjust its relative position with respect to said first parallel support arm, the relative position between them being, in this embodiment, the width of the magnet itself in the dimension of separation, or the spacing required by a fixed magnet 1030 and any securing means necessary. Owing to the magnetic attractive forces exerted by one or more fixed magnets 1030, the parallelogram positioning system can retain itself in any desired position despite having only one parallel support arm fixedly secured at one end and the second parallel support arm fixedly secured at an opposite or distal end.

Figure 11:
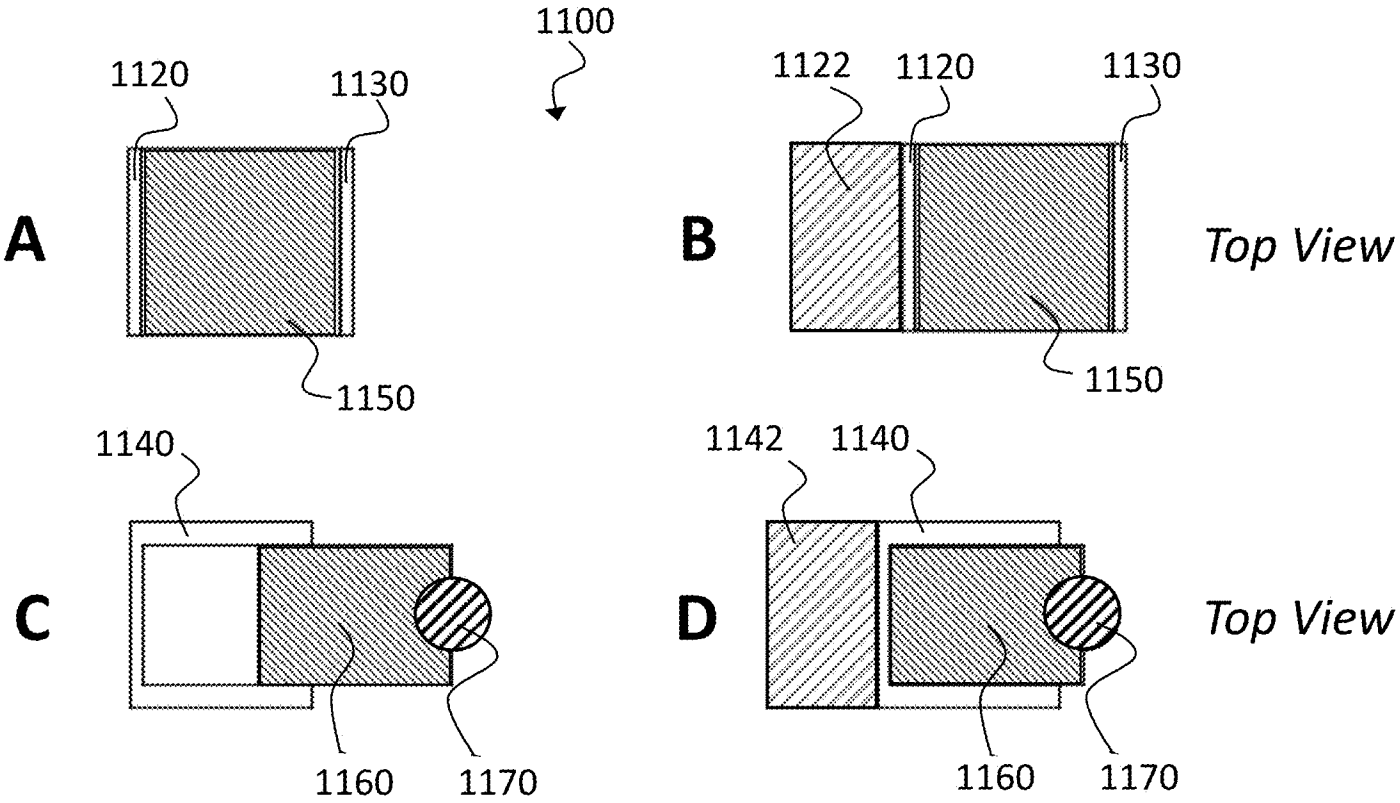
FIG. 11 shows a top view illustration of two embodiments of a parallelogram style coupling element, a first with a fixed magnetic positioning means with one fixed and one movable parallelogram support element, wherein the parallelogram components move with respect to one another as they are repositioned from a first to a second position, and a second with a movable magnetic position means that moves as the parallelogram support elements are repositioned from a first to second angular position.

FIG. 11 shows a top view illustration of two embodiments of a magnetic parallelogram positioning system as discussed hereinabove, illustrating a first embodiment with a fixed magnetic positioning means with one fixed and one movable parallelogram support element, wherein the parallelogram components move with respect to one another as they are repositioned from a first to a second position, and a second embodiment with a movable magnetic positioning means that enables the magnet(s) to move as the parallelogram support elements are repositioned from a first to second angular position.

FIG. 11 shows one embodiment of a magnetic support mechanism 1100 that uses one or a plurality of fixed magnetic elements 1150 that are attracted to and which then magnetically secure an outer parallel support arm 1120 to one surface thereof, and a second inner parallel support arm 1130 to an opposite or distal surface thereof, thus acting to magnetically couple and support the outer and inner parallel support arms in a fixed position with a fixed separation distance between them equivalent to the width of the magnetic element 1150 as shown in FIG. 11, view A, which shows a cutaway top view of a representative magnet secured between the two parallel support arms 1120 and 1130, when they are oriented normally or straight upward toward the viewer. In view B, the support arms have been angled in a direction toward the right of the figure, so that the outer surface or side 1122 of the outer parallel support arm 1120 become visible as viewed from above. It is seen that in this embodiment, the relative spacing between the two parallel support arms 1120 and 1130 are maintained by the attraction of the magnets to the same separation distance as in view A, even though the two support arms are now at an angle facing towards the right side of the figure, as viewed from above.

In contrast, a second embodiment of a magnetic support mechanism 1100 using one or a plurality of sliding magnetic elements 1160 are shown in the two lower views, C and D. In view C, the first or outer parallel support arm 1140 is in the shape of a U-channel rather than a flat structure, so as to accommodate the sliding magnetic element 1160 within the internal U-channel of that support arm 1140. In the initial, upright position, as viewed from above, the second parallel support arm is a channel rod element 1170 rather than a flat structure, and serves as a means to secure the sliding magnetic element(s) 1160. In the view C, it is noted that the separation distance between the channel support 1140 and the channel rod element 1170 is large compared to view D, which shows this embodiment of a magnetic support mechanism 1100 now angled with respect to the initial normal or horizontal starting position shown in view C. As the two parallel support elements, 1140 and 1170 are repositioned at an angle in view D, the outer side 1142 of the channel support 1140 comes into view from above, and the sliding magnetic element 1160 is seen to be displaced inward toward the open U-channel of the channel support 1140 as the distance of separation of the two parallel supports, 1140 and 1170, shorten as their relative angle changes. In this and other related embodiments, the use of one or more of a slidingly moveable magnetic securement means can be used to control and maintain the position of a parallelogram positioning system in which the two parallel support arms are fixedly but rotatably connected at a fixed distance of separation, yet it is desirable to enable the angular relative movement and repositioning of the parallelogram positioning system with the use of applied manual force by a user, the magnetic elements being sufficiently strong so as to maintain the system in any desired position against the force of gravity.

The use of other configurations of parallel support arms with fixed and slidingly moveable or displaceable magnetic elements is within the scope and intent of the present disclosure, including using three or more parallel support arms, support arms having different geometries and shapes, as well as using one or a plurality of magnetic elements in a fixed or moveable configuration, and combinations of the two approaches to provide for alternative embodiments that provide a means for repositioning a light engine or other device while maintaining it in a relative horizontal orientation with respect to a starting horizontal orientation, while adjusting the height or horizontal distance from said light engine to a horizontal reference plane from a first to a second desired height or position using the means of magnetic attraction to hold the assembly in a desired position but enable its repositioning with ease by a user applying only moderate force.

Additional Features

In addition to those features disclosed and described hereinabove, further embodiments of the present invention may use removably fixable mounting means to attach said light engines to said coupling means and said support means, including for example, but not limited to magnetic balls, magnetic rings and magnetic coupling elements that have sufficient magnetic strength to hold and support the light engine as a sole means of attachment, enabling a user to readily separate magnetically coupled light engines from said coupling and support means for removal or replacement, and also to enable repositioning of said light bar onto another available and receptive magnetic coupling means and/or support means, allowing the light engines to be freely interchangeable without requiring a tool or other means to separate the respective fixtures from one another.

In addition to those features disclosed and described hereinabove, further embodiments of the present invention may use removably fixable mounting means to attach said light engines to said coupling means and said support means, including for example, but not limited to magnetic balls, magnetic rings and magnetic coupling elements that have sufficient magnetic strength to hold the light engine in any desired positional orientation, but also employing a second means of attachment to secure the light engine to said coupling and/or support means so that it is not readily removable. Such second attachment means include all common fasteners known in the art and include for example, but are not limited to, bolts, screws, pins, cotter pins, adhesive elements, and the like, requiring a tool or device to remove said fastener so that the light engine is movably positionable, but cannot readily be removed from said coupling and/or support means. In these particular embodiments, the strength of the magnetic coupling means need only be sufficient to maintain the light engine in its desired orientation and position, and provide a means of moving said light engine between a first and second desired orientation and position with little to moderate effort by a user.

In addition to those features disclosed and described hereinabove, further embodiments of the present invention may use any acceptable light source as a lighting means for said light engine, including for example, but not limited to, low voltage AC and DC lamps, high voltage AC lamps, neon lamps and neon tube lights, fluorescent lamps, light emitting diodes (LEDs), ultraviolet diodes (UVDs) and laser light emitting diodes (LLEDs), luminescent panel lights, inductive lighting systems, glow-in-the-dark phosphor elements, and the like. Suitable light emitting diodes for use herein include, but are not limited to, white red, blue, green, violet, yellow and blue LEDs, as well as RGB (red-green-blue) and RGBW (red-green-blue-white) LED matrices and combinations thereof, wherein the individual LED elements are combined in a matrix configuration and yet are individually addressable so as to enable the selection of any visible color of the spectrum, with fine degrees of hues selectable by the user. In additional embodiments, white lights can be selected providing various hues and intensities, including for example, but not limited to, white lights with temperature values of warm, cool and hot, which correspond to the absolute whiteness of the source light, warm white for instance having a yellow spectral component present, while hot white may have a blue spectral component present, as well as common variations known in the art.

In addition to those features disclosed and described hereinabove, further embodiments of the present invention may use any acceptable diffusion means for said light source, including for example, but not limited to, diffusing lens, Fresnel lens, prismatic lens, semi-opaque or translucent lenses and/or filters, prisms, gratings, and the like.

In addition to those features disclosed and described hereinabove, further embodiments of the present invention include control means to turn the lighting systems on and off, enable dimming of the light intensity from a full intensity to any desired lower intensity, including off, and the ability to adjust color mixing by selecting a desired RGBW (red, green, blue, white) balance (hue) by selecting a desired hue in combination with an electronic controller that automatically adjusts the intensity of a series of red, green and blue LEDs or other light sources to produce the desired hue, as well as control of other light sources as disclosed hereinabove.

In additional embodiments, the present invention includes remote sensor means to detect the approach, motion and/or proximity of a user, said sensor means interacting with an electronic control means to operate to turn the lighting system on and off. In related embodiments, one or more of a motion, proximity and position sensor can also be employed to enable the user to control the light intensity and color mixing of light emitted by the inventive device by means of moving an appendage, such as a hand or finger, in a predetermined direction or orientation, so as to signal the proximity and/or position sensors of said motion, wherein said electronic control means acts to interpret said motion and then operates to adjust the light intensity and color mixing in response to the user's motion. In yet another embodiment, the electronic control means can send a control signal to another device and/or receive a control signal from another device, so that for example, a set of light engines can be simultaneously controlled by means of controlling a single light engine within a group.

In further embodiments, the multimount attachment system described herein is configurable to enable the attachment of said light engines to any desired surface, including for example, but not limited to, a chair, floor, bench, desk or table top, wall, vertical or horizontal surface or partition, ceiling, computer monitor or television display module; or to an edge of an object, such as for example, but not limited to, an edge of a bench, table, chair arm, cubicle framing element, and the like.

The above illustration provides many different embodiments or embodiments for implementing different features of the invention. Specific embodiments of components and processes are described to help clarify the invention. These are, of course, merely embodiments and are not intended to limit the invention from that described in the claims.

Although the invention is illustrated and described herein as embodied in one or more specific examples, it is nevertheless not intended to be limited to the details shown, since various modifications and structural changes may be made therein without departing from the spirit of the invention and within the scope and range of equivalents of the claims. Accordingly, it is appropriate that the appended claims be construed broadly and in a manner consistent with the scope of the invention, as set forth in the following claims.

What is claimed is:

1. A parallelogram positioning system for a modular lighting system comprising:

(a) a mounting element; wherein said mounting element is configured to be removably attachable to a surface; wherein said mounting element has a first proximate side configured to attach to a receptive surface and a second distal side; wherein said mounting element is selected from a mounting means capable of attaching to a flat horizontal surface, flat vertical surface, an edge or surface of an object selected from a cubicle wall, table, chair, computer monitor, display screen, keyboard, desk, pole and office equipment;

(b) a first coupling element, removably attachable to said second distal side of said mounting element; wherein said first coupling element has a first proximate side configured to removably attach to said mounting element and a second distal side configured to removably attach to a parallelogram positioning element;

(c) a parallelogram positioning element being a parallel configuration of two support elements;

wherein a first proximate end of at least one of said support elements is rotatably attached to a said mounting element; and wherein a second distal end of at least one of said support elements is rotatably attached to said first coupling element;

wherein said support elements are constructed of a material or have an associated surface thereon that is strongly attracted to a magnetic force exhibited by a magnet;

(d) at least one or a plurality of magnetic elements; wherein said magnetic elements are either fixed in position with respect to one of said support elements or are configured to be linearly slidingly engageable with one of said support elements;

wherein said magnetic elements are positioned between said support elements so as to be physically in contact with both of said support elements simultaneously; wherein the magnetic attractive force exhibited by said magnetic elements is strong enough to retain and maintain the relative positions of the said two support elements in a parallel configuration with respect to one another;

wherein said magnetic attractive force can be overcome by the application of an external mechanical force exhibited by a human user to change the relative position of said two support elements with respect to one another;

(e) a second coupling element; wherein a first proximate side is connected to at least one distal end of at least one of said support elements; wherein the second distal side of said second coupling element is configured to be removably attachable to a light engine; (f) a light engine, removably attachable to said second coupling element;

wherein said magnetic elements are fixed in position with respect to one of said support elements;

wherein said two support elements are each rotatably attached at both of their proximate ends to said mounting element;

wherein said two support elements are rotatably attached at both of their distal ends to said coupling element; and wherein said magnetic elements are each attached to only one or more of said support elements; and wherein said magnetic elements are configured to be linearly slidingly engageable with the support element to which they are not attached; wherein said magnetic elements enable the distance between the said two support elements to vary as a function of the angle of said support elements as the support elements are moved with respect to a horizontal reference plane.

* * * * *